US005441260A

United States Patent [19]

Gogarty

[11] Patent Number: 5,441,260

[45] Date of Patent: Aug. 15, 1995

[54] 3-DIMENSIONAL MAZE PUZZLE

[76] Inventor: Brian J. Gogarty, 385 S. Liberty, Elgin, Ill. 60120

[21] Appl. No.: 10,879

[22] Filed: Jan. 29, 1993

[51] Int. Cl.[6] ..... A63F 9/08

[52] U.S. Cl. ..... 273/153 R; 273/156

[58] Field of Search ..... 273/153 R, 156; 70/289, 70/290

[56] References Cited

U.S. PATENT DOCUMENTS

| | | | |
|---|---|---|---|
| 3,594,005 | 7/9971 | Vennola | 273/153 R |
| 3,819,187 | 6/1974 | Downs | 273/156 |
| 3,824,815 | 7/1974 | Darling | 273/156 |
| 3,873,096 | 3/1975 | Shoptaugh | 273/156 |
| 4,065,132 | 12/1977 | Giakas | 273/153 R |
| 4,487,417 | 12/1984 | Engel | 273/153 R |
| 4,685,679 | 8/1987 | Ben-Gal et al. | 273/153 R |
| 4,805,910 | 2/1989 | Monticolombi et al. | 273/153 R |
| 4,861,036 | 8/1989 | Watanabe | 273/153 R |
| 4,974,848 | 12/1990 | Gieseker | 273/153 R |

*Primary Examiner*—V. Millin
*Assistant Examiner*—Steven B. Wong

[57] ABSTRACT

An inner bar and a sleeve thereon, slidable and rotatably mounted on the bar. Maze grooves are formed in the bar and a follower rides in the grooves. The follower is a pin, or a ball, as desired, and in the case of the ball, it is captured, or free moving, in different forms. In one form the bar is made up of sections which can be pre-positioned selectively to form different overall patterns of grooves. In one form, the parts of the device are of different colors.

10 Claims, 2 Drawing Sheets

3-DIMENSIONAL MAZE PUZZLE

SUMMARY OF THE INVENTION

The invention resides in the general field of maze puzzles having a plurality of connected grooves at different angles, and a ball rolling in the grooves, the object being for the player to roll the ball into and through the grooves, exercising his skill.

A main object of the invention is to provide a maze puzzle of the foregoing general character, that is of 3-dimensional character, having a continuous maze component extending circumferentially around the puzzle, enabling the ball to be moved continuously in the same general direction, around the puzzle.

A more specific object is to provide a device of the foregoing character that is made up of an inner part and outer sleeve thereon, wherein the maze grooves are formed in the inner part, enabling greater accuracy and minimum cost in making the device.

Another object is to provide a maze puzzle of the foregoing character wherein various ones of the parts may be made selectively of transparent, or non-transparent, material to provide a highly versatile kind of puzzle.

Another object is to provide a 3-dimensional maze puzzle which enables a follower ball to be moved through the interior or body of the puzzle, from one area of maze grooves to another area of those grooves.

Yet another object is to provide a maze puzzle of the foregoing character which has a plurality of sections that together form a single maze pattern, and wherein the sections can be individually adjusted for varying the pattern.

Still another object is to provide a maze puzzle of the foregoing character that includes a novel feature of producing a signal, such as a visual signal or audio signal, upon the follower ball falling into a predetermined location.

A still further object is to provide a maze puzzle of the foregoing character having a transparent outer sleeve, making the follower ball visible, and in view of its 3-dimensional nature, the puzzle may be easily handled and manipulated by a patient lying on his back and holding the puzzle above, in this arrangement the follower ball being at the bottom of the puzzle for observance by the patient, and the entire puzzle may be manipulated in the same manner, or a complementary manner, as by a person holding it in a normal position and looking down on it.

BRIEF DESCRIPTIONS OF THE INDIVIDUAL FIGURES OF THE DRAWINGS

DETAILED DESCRIPTION

Figure 1:
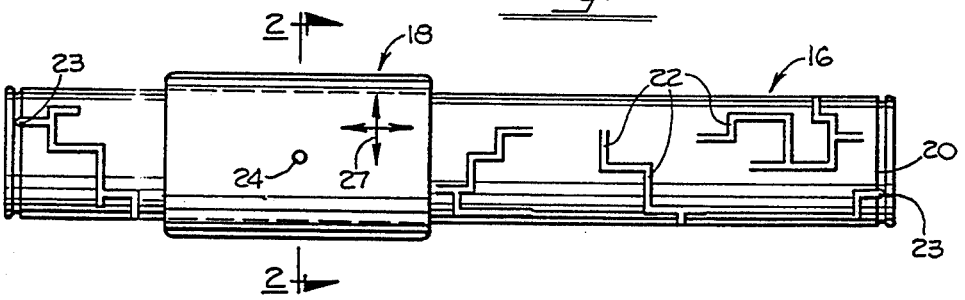
FIG. 1 is a face view of a 3-dimensional maze puzzle embodying the features of the present invention.
Figure 2:
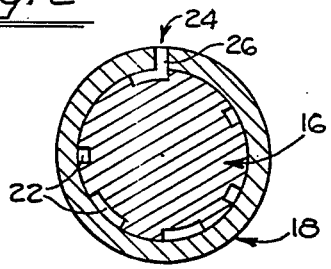
FIG. 2 is a sectional view taken at line 2—2 of FIG. 1.
Figure 3:
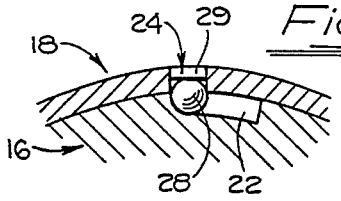
FIG. 3 is a fragmentary view similar to that of FIG. 2 showing an alternate detail of construction.
Figure 4:
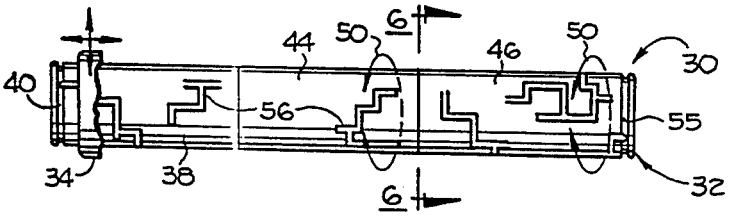
FIG. 4 is a face view of the inner part of a modified form of puzzle.
Figure 5:
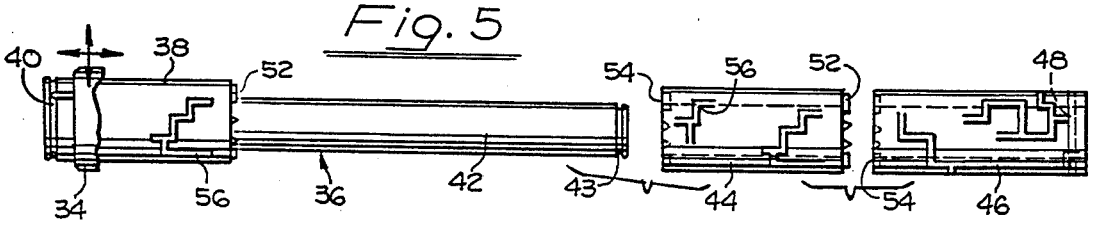
FIG. 5 is similar to FIG. 4 but in exploded position.
Figure 6:
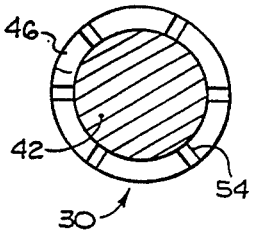
FIG. 6 is a view taken at line 6—6 of FIG. 4.
Figure 7:
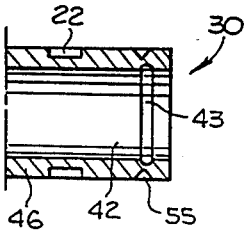
FIG. 7 is a fragmentary sectional view of connecting construction utilized in the right hand end of the component of FIG. 4.
Figure 8:
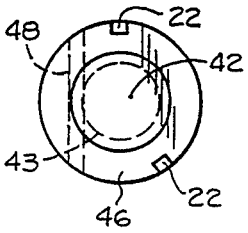
FIG. 8 is a view from the right of FIG. 6.

Referring in detail to the drawings attention is directed first to FIGS. 1–3 showing the puzzle of the invention in its entirety. The puzzle of this form is made up of two main parts, namely, an inner bar 16 and a sleeve 18 thereon. These parts may be made of any suitable material, but preferably plastic, but certain other detail elements may be made of other materials referred to hereinbelow. The bar 16 forms a centerpiece or core and it may be solid, or hollow, as desired. It is cylindrical in shape and has circumferential detent grooves 20 at the ends to hold the sleeve 18 thereon.

The bar has maze grooves 22 of various lengths and various directions, as in maze puzzles. These grooves in the aggregate may extend throughout the length of the bar between the detent grooves 20 and of course the pattern, or patterns, may be as desired. The maze grooves 22 preferably enter into the detent grooves 20 as indicated at 23.

The sleeve 18 is fitted on the bar 16 and it includes a follower 24, which may be of different kinds, e.g. as in FIG. 2, it is in the form of a pin 26 secured in the sleeve with its inner end extending into the grooves 22. The follower 24 may be at any desired location in the sleeve 18, lengthwise, and may for example be in the middle. The sleeve is slidable and rotatable on the bar as indicated at 27, and is slid and rotated according to the progress of the follower through the maze grooves. The detent grooves 20 may be of the same depth as the maze grooves and the follower 24 rides into the detent grooves and the sleeve is thereby held on the bar. When the follower is in the middle of the sleeve, then the corresponding end portions of the sleeve extend over the ends of the bar in the extreme positions of the sleeve.

FIG. 3 shows another form of follower 24, which is a floating ball 28. The ball 28 may be held in place and is encapsulated in the sleeve in any convenient and known manner, such as providing a hole through the wall of the sleeve to accept the ball, and filling the hole with a plug 29. The ball is thus arranged for extending into and following the maze grooves.

The sleeve 18 may be opaque, and in one form of the device, is preferably opaque to render the puzzle more difficult to play, and to provide corresponding interest in it. When the grooves covered by the sleeve are not visible, the player must rely on his memory as to their shape and position.

It will be understood that the maze grooves 22 form a pattern that extends in any desired direction or to any extent, and preferably extends entirely circumferentially around the bar. The grooves form a predetermined pattern, and the pattern can lead in any direction, i.e. either longitudinally, or circumferentially, and in circumferential direction, the follower, with the sleeve, is capable of progressing continuously circumferentially around the bar in the same general direction, i.e., the pattern does not terminate at side edges, where the sleeve would have to be reversed and moved in the opposite direction. In referring to circumferential direction, it is understood that this is to distinguish from longitudinal direction, and although segments of the grooves may extend longitudinally for short distances, the general direction is continuously circumferential.

FIGS. 4–8 show a modified form of maze indicated in its entirety at 30, the bar or centerpiece at 32, and the sleeve at 34 which may be identical with the sleeve 18.

In this case, the bar 32 is made up of sections. A main part of the bar is indicated at 36 and is preferably a solid integral piece. It includes a large portion 38 with a retention groove 40 at one end, and a turned down reduced shank 42 opposite the head, the latter having a circumferential groove 43 at its extended end. The bar includes two tubular sections 44, 46 that are slidable on the shank 42 up to the large portion 38 which may also be referred to as a section, with the section 44 engaging the section 38 and the section 46 engaging the section 44. The sections 44, 46 are held on the shank 42 by a pin 48 (FIGS. 5,8) mounted in the section 46 and slidably fitted in the groove 43, enabling rotation of the section on the shank as indicated by the arrows 50 in FIG. 4.

The sections 38, 44, 46 at their meeting ends have teeth and notches 52, 54 which interengage and releasably hold the sections in position rotationally. These teeth and notches are shown highly exaggerated, and as understood in the trade in making such plastic pieces, they may be very fine, actually only several thousandths of an inch in depth, but they provide a snap-in feel or sound, when the adjacent sections fall into predetermined position. When the sections are positioned with the grooves cooperatively aligned, this may be referred to as a working position. The section 46 has a retention groove 55 at its end opposite the groove 40.

The sections 38, 44, 46 are provided with maze grooves 56, identical with the grooves 22, and the sections and grooves thereon may be arranged so that the sections can be rotated to different positions in which the grooves, passing from one section to another, are continuous, but the overall pattern of the grooves changes according to the rotational positions of the sections.

Figure 9:
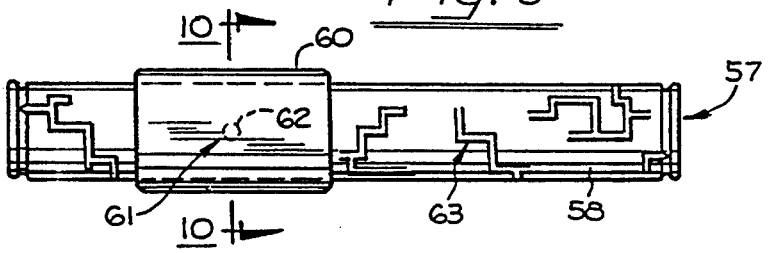
FIG. 9 is a face view of another form of puzzle.
Figure 10:
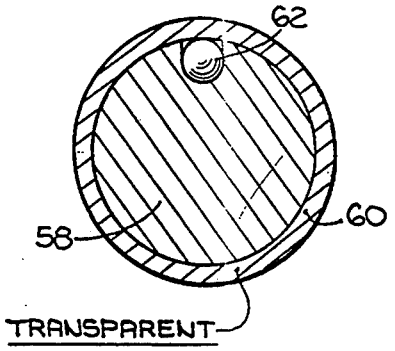
FIG. 10 is a sectional view taken at line 10—10 of FIG. 9.
Figure 11:
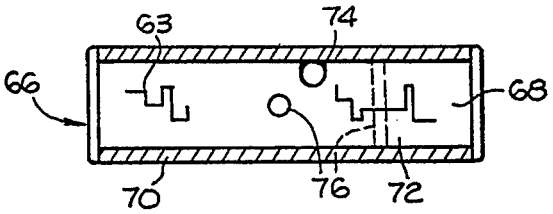
FIG. 11 is a partial sectional view showing another feature of the invention.
Figure 12:
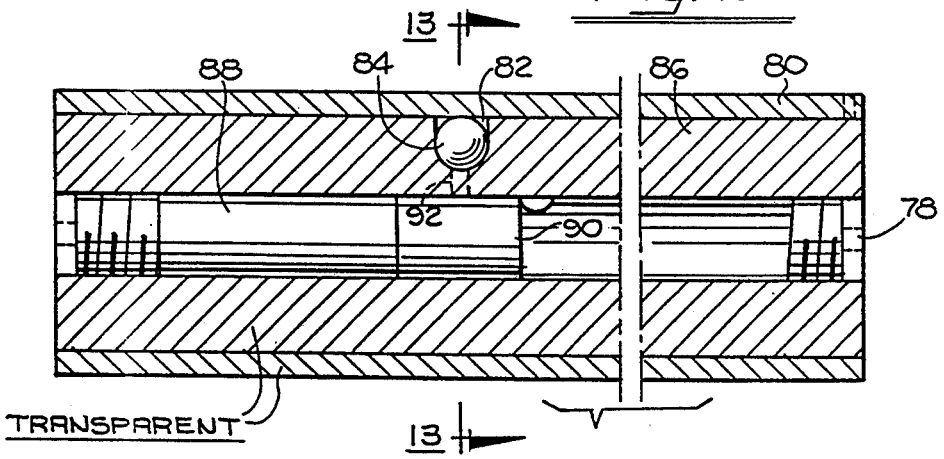
FIG. 12 is a sectional view showing additional features of the device of the invention.

Reference is next made to FIGS. 9 and 10 showing another form of puzzle. In this case the puzzle indicated in its entirety at 57 includes a bar 58 similar to the bar 16, and a sleeve 60 similar to the sleeve 18, but transparent. As indicated at 61, the follower 62 is in the form of a ball, the ball 62 being free-moving, and not captured by the sleeve, and free to roll freely in the grooves. The transparency of the sleeve enables viewing the ball. The sleeve may be shorter than the bar and slid along to different portions of the bar, or it may be effectively as the same length of the bar as shown in FIGS. 11 and 12. The bar includes the maze grooves 63.

FIG. 11 shows another form of the puzzle, embodying another and interesting feature of the invention. In this case the puzzle is indicated at 66, having an inner bar 68 and a sleeve 70. The specific mechanical construction of the bar and sleeve may be as desired, but the sleeve extends the full length of the bar. The follower in this case is a ball 74 which rolls in the maze grooves 63. The principal feature in this form is that the bar 68 is provided with one or more diametrical holes 76 which extend through the bar and communicate with the grooves on the opposite sides, and the holes themselves forming additional passages in the maze. The holes 76 may be provided at any desired location longitudinally.

Figure 13:
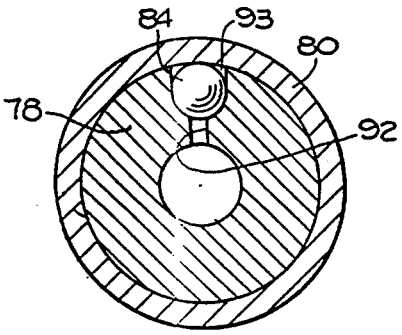
FIG. 13 is a sectional view taken at line 13—13 of FIG. 12.

It is also within the scope of the invention to provide signals indicating the ball dropping into a predetermined location, as in FIGS. 12 and 13. The puzzle in this case includes a bar 78, which is hollow, and a sleeve 80 preferable extending the full length of the bar. The bar 78 is provided with maze grooves 82, and a follower ball 84 rolls freely in the grooves.

Positioned in the interior of the bar 78 is a battery 88 and an indicator component 90 which may be of visual type such as a light, or audio type, and leading from the component 90 are conductor wires 92 and terminating in an element 93 of the grooves 82. The ball is of conductive material, such as steel, and when it falls into the groove element 93 it makes contact between the conductors 92 and actuates the signal component 90. In this case either the bar 78 or the sleeve 80 may be transparent so that the light signal may be observed by the user. Alternatively, either may be of luminescent material instead, if desired. Such a groove element 93 may be provided at a single location, or at various locations, as desired, and those groove elements may be indicated visually so that the player may work toward them, or they may be not indicated to require more skill in the playing of the game.

Figure 14:
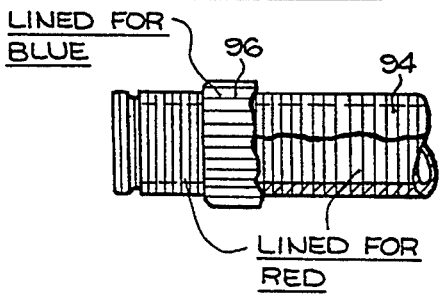
FIG. 14 is a partial sectional view of a modified form of device.

Another important feature of the invention is that the parts of the device, i.e., the bar and the sleeve, may be made of different colors, adding to the attractiveness of the device. These different colors may be both in the case of opaque materials and transparent materials, with corresponding visual impact. For example as shown in FIG. 14, the bar 94 is shaded for red, and the sleeve 96 for blue. These colors are effective as simply attractive coloring, but additionally in the form of device shown in FIGS. 12 and 13 where the materials of either the bar or the sleeve are transparent, the light from the signal shows through, the different colorings producing a very unusual and attractive effect.

As used herein, transparent is to be interpreted as including translucent, the degree of light that is transmitted not being significant.

When the internal light 90 is incorporated in the device, it is understood that the bar may be of transparent material, but the sleeve may or may not be transparent, as desired. Even if the sleeve is opaque, the light transmitted through the bar is quite effective, but when a transparent sleeve is also utilized the light transmitted therethrough also has a different and attractive effect. Also in the latter case, when both the bar and sleeve are transparent, they may be made of different colors as referred to above, but the scope of the invention is such that it also covers the case where the sleeve is opaque.

I claim:

1. A maze puzzle comprising, a central cylindrical bar having maze grooves in its outer surface, the grooves forming a maze of relatively short interconnected longitudinal and circumferential segments, a sleeve slidable and rotatable on the bar, the central bar being made up of a plurality of longitudinally spaced sections, that are rotatable relative to each other, a follower on the inner surface of the sleeve extending into the maze grooves and following in and along the segments thereof in response to the sliding and rotating movements of the sleeve, and the sections having at least certain of the longitudinal segments of the maze grooves therein opening through the ends of the sections that face other sections, whereby to enable those certain longitudinal segments in adjacent sections to be aligned and enable to follower to pass between such aligned segments.

2. A maze puzzle according to claim 1 wherein, the sections have a working position in which the longitudinal segments of the maze grooves are aligned, and the adjacent ends of adjacent sections have interengaging means releasably holding those sections in said working position.

3. A maze puzzle according to claim 1 wherein, the cylindrical bar and the sleeve are of different colors.

4. A maze puzzle according to claim 3 wherein, the sleeve is transparent.

5. A maze puzzle according to claim 3 wherein, the sleeve is of luminescent material.

6. A maze puzzle comprising, a central cylindrical bar having maze grooves in its outer surface, the grooves forming a maze of relatively short interconnected longitudinal and circumferential groove segments, a sleeve on the bar, a loose ball in the grooves encapsulated in the sleeve, the bar and sleeve being proportioned to provide a space therebetween encircling the bar, and the bar having a hole therethrough interconnecting the portions of the space on opposite sides of the bar, and the hole itself thereby forming an additional maze passage interconnecting corresponding ones of said maze grooves.

7. A maze puzzle comprising, a central cylindrical bar having maze grooves in its outer surface, the grooves forming a maze of relatively short interconnected longitudinal and circumferential segments, a sleeve slidable and rotatable on the bar, a follower on the inner surface of the sleeve extending into the maze grooves and following in and along the segments thereof in response to the sliding and rotating movements of the sleeve, the bar being hollow, signal means positioned in the hollow bar, and the maze puzzle including means for energizing the signal means in response to the follower entering into a predetermined location in the maze grooves.

8. A maze puzzle according to claim 7 wherein, the bar is of transparent material, and the signal means is a light.

9. A maze puzzle according to claim 8 wherein, the sleeve is also of transparent material, and the light from the signal light is transmitted through both the bar and sleeve.

10. A maze puzzle according to claim 9 wherein, the bar and sleeve are of different colors.

* * * * *